US006481020B1

(12) United States Patent
Kirkland

(10) Patent No.: US 6,481,020 B1
(45) Date of Patent: Nov. 19, 2002

(54) HEAD WRAP FOR KEEPING A HAIRSTYLE OF A USER IN PLACE WHILE SLEEPING

(76) Inventor: Shirley A. Kirkland, 308 Garden Acre Way, Pooler, GA (US) 31322

( * ) Notice: Subject to any disclaimer, the term of this patent is extended or adjusted under 35 U.S.C. 154(b) by 0 days.

(21) Appl. No.: 09/925,516

(22) Filed: Aug. 9, 2001

(51) Int. Cl.[7] ..... A41B 1/00
(52) U.S. Cl. ..... 2/174; 2/171; 2/204; 2/DIG. 11
(58) Field of Search ..... 2/174, 171.8, 171.7, 2/171.6, 171.5, 171.4, 171, DIG. 11, 204, 172, 207, 182.3, 181, 171.2, 209, 208, 209.3; 132/274

(56) References Cited

U.S. PATENT DOCUMENTS

| | | | | | |
|---|---|---|---|---|---|
| 1,633,586 | A | * | 6/1927 | Hunter | |
| 1,897,146 | A | * | 2/1933 | Richardson | |
| 1,991,982 | A | * | 2/1935 | Hodges | 2/174 |
| 2,086,359 | A | * | 7/1937 | Gordon | 2/174 |
| 2,211,184 | A | * | 8/1940 | Varell | 2/174 |
| 2,700,977 | A | * | 2/1955 | Neerup | 132/46 |
| 2,996,724 | A | * | 8/1961 | Rose et al. | 2/171 |
| 3,064,267 | A | * | 11/1962 | Tullos | 2/174 |
| 3,131,400 | A | * | 5/1964 | Blanchard et al. | 2/68 |
| 3,197,787 | A | * | 8/1965 | Tognan et al. | 2/171 |
| 3,295,536 | A | * | 1/1967 | Shaw et al. | 132/53 |
| 3,529,308 | A | * | 9/1970 | McBride | 2/174 |
| 4,491,985 | A | | 1/1985 | Dalton | 2/171 |
| 4,675,919 | A | * | 6/1987 | Heine et al. | 2/410 |
| 4,698,852 | A | * | 10/1987 | Romero | 2/171 |
| 4,790,035 | A | | 12/1988 | Whyte | 2/207 |
| 4,964,175 | A | | 10/1990 | Taylor | 2/171 |
| 5,035,006 | A | * | 7/1991 | Hetz et al. | 2/209.1 |
| 5,490,528 | A | | 2/1996 | Day | 132/200 |
| 5,594,956 | A | | 1/1997 | Barrientos | 2/207 |
| 5,621,919 | A | | 4/1997 | Graham | 2/174 |
| 5,708,982 | A | * | 1/1998 | Armani | 2/171 |
| 5,920,909 | A | * | 7/1999 | Ellsworth et al. | 2/171 |
| D424,743 | S | * | 5/2000 | Winter | D28/41 |
| 6,076,532 | A | | 6/2000 | Thomas et al. | 132/273 |

* cited by examiner

*Primary Examiner*—Gloria M. Hale
*Assistant Examiner*—Alissa L. Hoey
(74) *Attorney, Agent, or Firm*—Richard L. Miller

(57) ABSTRACT

A head wrap for keeping a hairstyle of a user in place while sleeping. The wrap includes a forehead-covering portion and a back of the head-covering portion. The forehead-covering portion has a forehead comfort strip that extends therealong. The back of the head-covering portion includes a pair of head-covering portions that are generally triangular-shaped and flare rearwardly from the forehead-covering portion to bases that are free and overlap each other vertically along the middle of the back of the head of the user. The base of one head-covering portion has a series of first portion of hook and loop fasteners and the base of the other head-covering portion has a series of second portion of hook and loop fasteners that engage the series of first portion of hook and loop fasteners to maintain the head wrap around the head of the user.

6 Claims, 1 Drawing Sheet

FIG.1
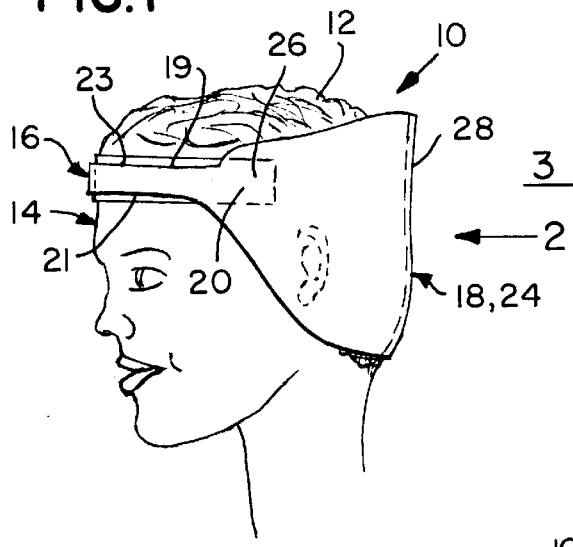
FIG.2
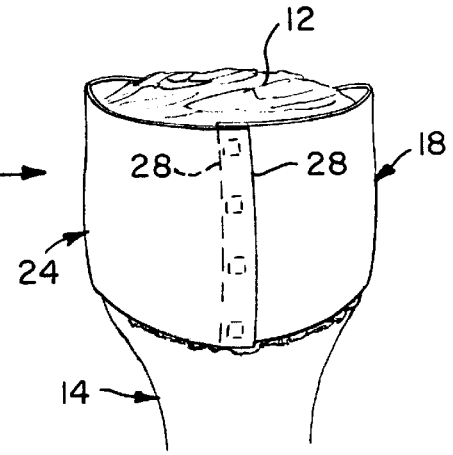
FIG.4
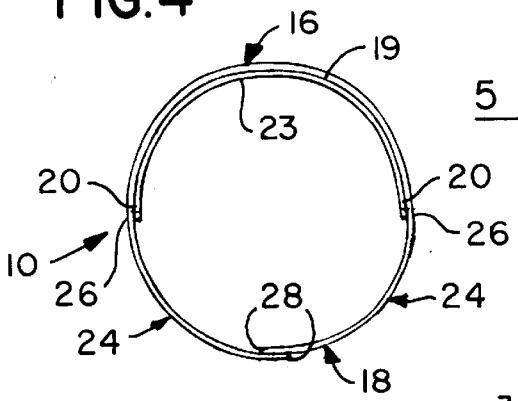
FIG.3
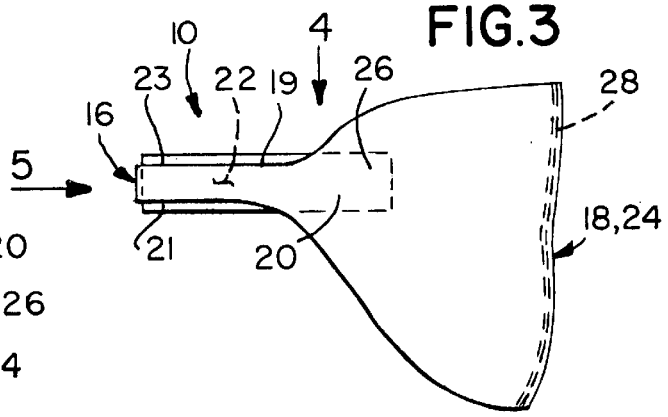
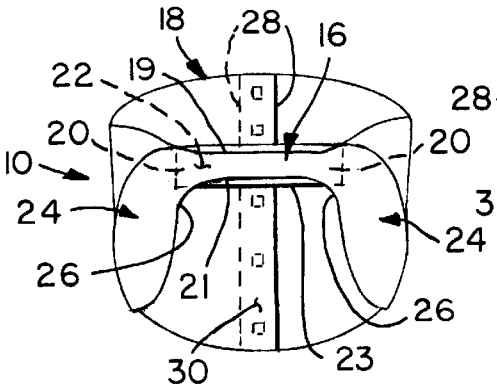
FIG.5
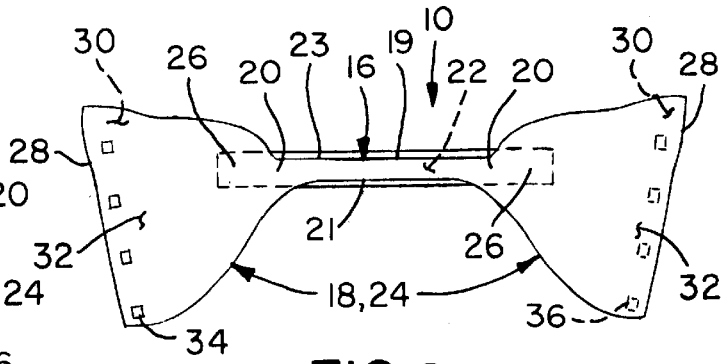
FIG.6

HEAD WRAP FOR KEEPING A HAIRSTYLE OF A USER IN PLACE WHILE SLEEPING

BACKGROUND OF THE INVENTION

1. Field of the Invention

The present invention relates to a head wrap. More particularly, the present invention relates to a head wrap for keeping a hairstyle of a user in place while sleeping.

2. Description of the Prior Art

Numerous innovations for head wraps have been provided in the prior art that will be described. Even though these innovations may be suitable for the specific individual purposes to which they address, however, they differ from the present invention.

A FIRST EXAMPLE, U.S. Pat. No. 4,491,985 to Dalton teaches a head covering having the general appearance of a turban and made from elastic fabric so as to fit securely in a snug manner about the head. Liner components are of a fleecy material to partially fill the interior of the head covering and thereby compensate for the wearer's loss of hair to render the appearance of a head covering worn over a full head of hair.

A SECOND EXAMPLE, U.S. Pat. No. 4,790,035 to Whyte teaches a turban hat comprising an elongate strip of material having two arms, respective arms extending from a mid-point between the ends of the strip to a respective distal one of said ends and each arm having first and second edges, at least one of said arms being looped around the other, each arm having at least a portion of either of its edges adjacent its distal end attached to at least a portion of an edge of an are adjacent the midpoint and at least a portion of either of its edges adjacent its distal end attached to at least a portion of an edge of the other arm adjacent the distal end, the loop being arranged so that one arm can be pulled through the other arm to alter the "hat size"of the headgear. Preferably a first portion of a first edge of one arm adjacent the distal end of said arm is attached to a second portion of said edge of said arm adjacent said mid-point and a first portion of a first edge of the other arm adjacent the distal end of said arm is attached to a second portion of said edge of said arm adjacent said mid-point.

A THIRD EXAMPLE, U.S. Pat. No. 4,964,175 to Taylor teaches a fabric body of a device that includes an inner satin-like fabric resistant to entanglement with hair engaged thereby, and an outer fabric which imparts strength, durability and cushioning to the device. Rear and side sections of the device respectively overlie the rear and sides of the head of a person wearing it. Strap-like sections extend from the side sections around the front, the opposite side, and part of the rear of the head of the user. Each strap-like section has a band of fastener material which releasably engages complementary fastener material upon the outer surface of the rear section of the device. A flap-like upper portion of the rear section of the device may be folded rearwardly and downwardly into overlying relationship with the fastener material and the outer ends of the strap-like sections. The upper and lower edges of the rear and side section of the body of the device are curved.

A FOURTH EXAMPLE, U.S. Pat. No. 5,490,528 to Day teaches a fitted hair towel for drying hair naturally, thereby avoiding the damaging effects associated with typical electric heat drying apparatus. The fitted hair towel is adapted to fit securely on the head so that it can be worn during any activity undertaken by the wearer without restricting the range of motion. An elasticized top edge of the towel member is wrapped from the back of the head at the hairline around the sides of the head to the forehead where inverted corners are secured by fasteners. The towel member is wrapped around the hair to form a towel tube. The towel tube is twisted and wrapped over the top and against the back of the wearer's head. A strap member at the bottom edge of the towel member is pulled to draw together openings located at the bottom edge, thereby gathering the bottom edge. Opposing ends and of the strap member are wrapped around either side of the wearer's head and cooperative fastening means are engaged at the wearer's forehead to secure the towel member in a wrapped configuration.

A FIFTH EXAMPLE, U.S. Pat. No. 5,594,956 to Barrientos teaches a head bandanna for protecting and covering the head area, which is used in sporting, recreational and work activities and includes a head covering made of fabric having a front and a rear portion, wherein the front portion has a front curved edge substantially in the shape of a semicircle. There is also a curved headband made of absorbent material and having the shape of a longitudinal strip and being integrally connected to the front curved edge of the front portion of the head covering at a 90 degree angle facing downwardly relative to the headband. Velcro closure tabs are connected to opposite ends of the headband for fitting the head bandanna on the wearer's head in a conforming and secure fit.

A SIXTH EXAMPLE, U.S. Pat. No. 5,621,919 to Graham teaches a convenient hair wrap which covers the rear portion of the head and allows for retention of the hair at that portion to retain a hair style or the like, and is easily positionable and securable on a wearer's head. Additionally, the hair wrap provides an aesthetically pleasing hair cover which may be worn out in public and still present a fashionable look.

A SEVENTH EXAMPLE, U.S. Pat. No. 6,076,532 to Thomas et al. teaches a combination head/hair band and hair gathering device(s) that is comprised of two or more joined flexible textile loops featuring adjustable circumferences. The first loop is intended to wrap around the users head and serve as a head/hair band. The second loop or loops is/are attached to the primary loop at the location(s) from which gathered hair, i.e. ponytail/pigtails/hair braid(s), are intended to be secured. The gather hair is routed through the second loop(s) and secured by tensioning of slide device(s) defining the loop circumferences. In the one embodiment, a single length of a flexible textile cordage is routed over the wearers head and both ends are then routed through a first slide device positioned underneath the hair at the back of the head. The hair is ten gathered and the cord ends are routed around opposite sides of the gathered hair, and tensioned and secured with a second slide device. The device is very elegant in its simplicity and effectiveness in restraining the hair.

It is apparent that numerous innovations for head wraps have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a head wrap for keeping a hairstyle of a user in place while sleeping that avoids the disadvantages of the prior art.

ANOTHER OBJECT of the present invention is to provide a head wrap for keeping a hairstyle of a user in place while sleeping that is simple and inexpensive to manufacture.

STILL ANOTHER OBJECT of the present invention is to provide a head wrap for keeping a hairstyle of a user in place while sleeping that is simple to use.

BRIEFLY STATED, STILL YET ANOTHER OBJECT of the present invention is to provide a head wrap for keeping a hairstyle of a user in place while sleeping. The wrap includes a forehead-covering portion and a back of the head-covering portion. The forehead-covering portion has a foreheadcomfort strip that extends therealong. The back of the head-covering portion includes a pair of head-covering portions that are generally triangular-shaped and flare rearwardly from the forehead-covering portion to bases that are free and overlap each other vertically along the middle of the back of the head of the user. The base of one head-covering portion has a series of first portion of hook and loop fasteners and the base of the other head-covering portion has a series of second portion of hook and loop fasteners that engage the series of first portion of hook and loop fasteners to maintain the head wrap around the head of the user.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The FIGS. of the drawing are briefly described as follows:

FIG. 1 is a diagrammatic side elevational view of the present invention in use;

FIG. 2 is a diagrammatic rear elevational view taken generally in the direction of arrow 2 in FIG. 1;

FIG. 3 is an enlarged diagrammatic side elevational view taken generally in the direction of arrow 3 in FIG. 2 of the present invention;

FIG. 4 is a diagrammatic top plan view taken generally in the direction of arrow 4 in FIG. 3;

FIG. 5 is a diagrammatic front elevational view taken generally in the direction of arrow 5 in FIG. 3; and FIG. 6 is a diagrammatic front elevational view of the present invention prior to use.

LIST OF REFERENCE NUMERALS UTILIZED IN THE DRAWING

10 head wrap of present invention for keeping hairstyle 12 of user 14 in place while sleeping
12 hairstyle of user 14
14 user
16 forehead-covering portion
18 back of the head-covering portion
19 uppermost terminal edge of forehead-covering portion 16
20 pair of terminal ends of forehead-covering portion 16
21 lowermost terminal edge of forehead-covering portion 16
22 forehead-engaging surface of forehead-covering portion 16
23 forehead-comfort strip of forehead-covering portion 16
24 pair of head-covering portions of back of the head-covering portion 18, each of which for covering associated side and associated half of back of head of user 14
26 apex of each head-covering portion of pair of head-covering portions 24 of back of the head-covering portion 18
28 base of each head-covering portion of pair of head-covering portions 24 of back of the head-covering portion 18 for extending vertically along middle of back of head of user 14
30 back of the head-facing surface of base 28 of each head-covering portion of pair of head-covering portions 24 of back of the headcovering covering portion 18
32 ambient-facing surface of base 28 of each head-covering portion of pair of head-covering portions 24 of back of the head-covering portion 18
34 series of first portion of hook and loop fasteners extending along base 28 of one head-covering portion of pair of headcovering covering portions 24 of back of the head-covering portion 18 on ambient-facing surface 32 of base 28 of one head-covering portion of pair of head-covering portions 24 of back of the head-covering portion 18
36 second series of hook and loop fasteners extending along base 28 of other head-covering portion of pair of head-covering portions 24 of back of the head-covering portion 18 on ambient-facing surface 32 of base 28 of other head-covering portion of pair of head-covering portions 24 of back of the head-covering portion 18

DETAILED DESCRIPTION OF THE PREFERRED EMBODIMENT

Referring now to the FIGS, in which like numerals indicate like parts, and particularly to FIGS. 1 and 2, the head wrap of the present invention is shown generally at 10 for keeping a hairstyle 12 of a user 14 in place while sleeping.

The configuration of the head wrap 10 can best be seen in FIGS. 1–6, and as such, will be discussed with reference thereto.

The head wrap 10 comprises a forehead-covering portion 16, and a back of the head-covering portion 18 that extends from the forehead covering portion 16.

The forehead-covering portion 16 is slender, thin, and elongated.

The forehead-covering portion 16 is made of a polyester fabric.

The forehead-covering portion 16 has an uppermost terminal edge 19 that is horizontally-oriented, a pair of terminal ends 20, a lowermost terminal edge 21 that is horizontally-oriented, and a forehead-engaging surface 22.

The forehead-covering portion 16 further has a forehead-comfort strip 23 that extends along the forehead-engaging surface 22 thereof, horizontally from slightly past one terminal end 20 thereof to slightly past the other terminal end 20 thereof, and vertically from slightly past the uppermost terminal edge 19 thereof to slightly past the lowermost terminal edge 21 thereof.

The forehead-comfort strip 23 is made of foam.

The back of the head-covering portion 18 comprises a pair of head covering portions 24 that extend from the pair of terminal ends 20 of the forehead-covering portion 16, respectively.

The pair of head-covering portions 24 are mirror images of each other.

The pair of head-covering portions 24 are made of a polyester fabric and are made as one-piece with the forehead-covering portion 16.

Each head-covering portion 24 is generally triangular-shaped and flares rearwardly from the forehead-covering portion 16 for covering an associated side and an associated half of the back of the head of the user 14.

Each head-covering portion 24 has an apex 26 that is coincident with a respective terminal end 20 of the forehead-covering portion 16.

Each head-covering portion 24 flares rearwardly from the apex 26 thereof to a base 28 thereof that is free, vertically-oriented, overlap each other, and is for extending vertically along the middle of the back of the head of the user 14.

The base 28 of each head-covering portion 24 has a back of the headfacing facing surface 30 and an ambient-facing surface 32.

The base 28 of one head-covering portion 24 has a series of first portion of hook and loop fasteners 34 extending therealong on the ambient facing facing surface 32 thereof.

The base 28 of the other head-covering portion 24 has a second series of hook and loop fasteners 36 extending therealong on the back of the head-facing surface 30 thereof that engage the series of first portion of hook and loop fasteners 34 when the base 28 of each head covering portion 24 overlap each other for maintaining the head wrap 10 around the head of the user 14.

It will be understood that each of the elements described above, or two or more together, may also find a useful application in other types of constructions differing from the types described above.

While the invention has been illustrated and described as embodied in a head wrap for keeping a hairstyle of a user in place while sleeping, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A head wrap for keeping a hairstyle of a user in place while sleeping, comprising:

a) a forehead-covering portion; and b) a back of the head-covering portion;

wherein said back of the head-covering portion extends from said forehead-covering portion;

wherein said forehead-covering portion has an uppermost terminal edge;

wherein said uppermost terminal edge of said forehead-covering portion is horizontally-oriented;

wherein said forehead-covering portion has a pair of terminal ends;

wherein said forehead-covering portion has a lowermost terminal edge;

wherein said lowermost terminal edge of said forehead-covering portion is horizontally-oriented;

wherein said forehead-covering portion has a forehead-engaging surface;

wherein said forehead-covering portion has a forehead-comfort strip;

wherein said forehead-comfort strip extends along said forehead engaging surface of said forehead-covering portion;

wherein said forehead-comfort strip extends horizontally from slightly past one terminal end of said forehead-covering portion to slightly past the other terminal end of said forehead-covering portion;

wherein said forehead-comfort strip extends vertically from slightly past said uppermost terminal edge of said forehead-covering portion to slightly past said lowermost terminal edge of said forehead covering covering portion;

wherein said back of said head-covering portion comprises a pair of head-covering portions;

wherein said pair of head-covering portions extend from said pair of terminal ends of said forehead-covering portion, respectively;

wherein each head-covering portion is generally triangular-shaped;

wherein each head-covering portion flares rearwardly from said forehead-covering portion;

wherein each head-covering portion is for covering an associated side and an associated half of the back of the head of the user;

wherein each head-covering portion has an apex;

wherein said apex of each head-covering portion is coincident with a respective terminal end of said forehead-covering portion;

wherein each head-covering portion flares rearwardly from said apex thereof to a base thereof;

wherein said base of each head-covering portion is free;

wherein said base of each head-covering portion is vertically-oriented;

wherein said base of each head-covering portion overlap each other;

wherein said base of each head-covering portion is for extending vertically along the middle of the back of the head of the user;

wherein said base of each head-covering portion has a back of the head-facing surface;

wherein said base of each head-covering portion has an ambient-facing surface;

wherein said base of one head-covering portion has a series of first portion of hook and loop fasteners extending therealong;

wherein said first portion of hook and loop fasteners are disposed on said ambient-facing surface of said base of said one head-covering portion;

wherein said base of the other head-covering portion has a series of second portion of hook and loop fasteners extending therealong;

wherein said second portion of hook and loop fasteners are disposed on said back of the head-facing surface of said base of said other head-covering portion; and wherein said second series of hook and loop fasteners engage said series of first portion of hook and loop fasteners when said base of each head covering portion overlap each other for maintaining said head wrap around the head of the user.

2. The wrap as defined in claim 1, wherein said forehead-covering portion is slender;

wherein said forehead-covering portion is thin; and wherein said forehead-covering portion is elongated.

3. The wrap as defined in claim 1, wherein said forehead-covering portion is made of a polyester fabric.

4. The wrap as defined in claim 1, wherein said forehead comfort strip is made of foam.

5. The wrap as defined in claim 1, wherein said pair of head-covering portions are mirror images of each other.

6. The wrap as defined in claim 1, wherein said pair of head-covering portions are made of a polyester fabric; and wherein said pair of head-covering portions are made as one-piece with said forehead-covering portion.

* * * * *